US007198592B1

(12) United States Patent
Mancini

(10) Patent No.: US 7,198,592 B1
(45) Date of Patent: Apr. 3, 2007

(54) ABDOMINAL EXERCISER

(76) Inventor: Paul Mancini, 3689 Seminole, Windsor, ON (CA) N8Y 1Y5

( * ) Notice: Subject to any disclaimer, the term of this patent is extended or adjusted under 35 U.S.C. 154(b) by 236 days.

(21) Appl. No.: 10/402,427

(22) Filed: Mar. 28, 2003

(51) Int. Cl.
*A63B 26/00* (2006.01)
*A63B 71/00* (2006.01)

(52) U.S. Cl. ..... 482/140; 482/72; 482/79; 482/80

(58) Field of Classification Search ..... 482/907, 482/140, 121–123, 125–126, 129–130, 52, 482/92, 904, 79–80, 72, 142; D21/676, 686, D21/690
See application file for complete search history.

(56) References Cited

U.S. PATENT DOCUMENTS 5,230,676 A * 7/1993 Terauds ..... 482/53
5,275,579 A * 1/1994 Wilkinson ..... 482/52
5,860,898 A * 1/1999 Ellis ..... 482/130
5,951,445 A * 9/1999 Vittone et al. ..... 482/101
6,026,526 A * 2/2000 Payman ..... 5/602
6,537,185 B1 * 3/2003 Hur ..... 482/142
6,669,600 B2 * 12/2003 Warner ..... 482/8
6,740,011 B1 * 5/2004 Tsai et al. ..... 482/80
2004/0038786 A1 * 2/2004 Kuo et al. ..... 482/130

FOREIGN PATENT DOCUMENTS

CH 678395 A * 9/1991

* cited by examiner

*Primary Examiner*—Lori Amerson
(74) *Attorney, Agent, or Firm*—Miller Thomson LLP

(57) ABSTRACT

Abdominal exercisers allow a user to perform sit-ups without straining their back. A set of adjustable handles allow the user to use his or her arms and upper body to assist the upward motion of the torso if necessary, thereby reducing back strain. A head and neck cushion and seat cushion support the user, and footrests hold the user's feet in place. Nonskid pads are attached to the bottom of the abdominal exerciser to prevent it from slipping during use. The abdominal exerciser folds in half for ease of transport and storage.

2 Claims, 3 Drawing Sheets

ABDOMINAL EXERCISER

BACKGROUND OF THE INVENTION

1. Field of the Invention

The present invention relates to an abdominal exerciser for use in connection with exercise equipment. The abdominal exerciser has particular utility in connection with allowing a user to perform situps without straining their back.

2. Description of the Prior Art

Abdominal exercisers are desirable for allowing a user to perform situps without straining their back. Strong abdominal muscles are an important aspect of being physically fit. Moreover, it is recognized that many back problems are a result of weak abdominal muscles. However, persons just beginning an exercise program, particularly those already suffering from back pain, find it difficult to exercise their abdominal muscles by performing sit-ups. By providing adjustable handles, abdominal exercisers help reduce stress and strain on the lower back muscles, thereby enabling an easier means of performing sit-ups. The user can employ the muscles in their arms and upper body to assist in execution of sit-ups as needed while the abdominal muscles develop.

The use of abdominals and hip exercise machines is known in the prior art. For example, U.S. Pat. No. 6,390,960 to Boland discloses an abdominals and hip exercise machine. However, the Boland '960 patent does not have footrests, and has further drawbacks of lacking a counter.

U.S. Pat. No. 4,489,936 to Dal Monte discloses a gymnastic implement that trains all the body's muscles. However, the Dal Monte '936 patent does not have a counter, and additionally cannot fold in half.

Similarly, U.S. Pat. No. 5,722,923 to Lui discloses a device for abdominal muscle exercise that is for performing the so-called sit-up exercise. However, the Lui '923 patent does not have a counter, and does not have handles.

In addition, U.S. Pat. No. 5,618,250 to Butz discloses an aerobic exercise machine targeting trunk muscles that enables the user to conduct aerobic exercise using their trunk and hip flexor and extensor muscles. However, the Butz '250 patent does not fold in half, and also does not allow the user to lie flat during use.

Furthermore, U.S. Pat. No. Des. 355,002 to Bengtson discloses an abdominal muscle trainer that exercises the abdominal muscles. However, the Bengtson '002 patent does not have a counter, and further lacks adjustable handles.

Lastly, U.S. Pat. No. 1,905,019 to Turner discloses an exercising apparatus that exercises practically all muscles of the human body. However, the Turner '019 patent does not have a counter, and has the additional deficiency of lacking adjustable handles.

While the above-described devices fulfill their respective, particular objectives and requirements, the aforementioned patents do not describe an abdominal exerciser that allows allowing a user to perform situps without straining their back. The Boland '960 patent makes no provision for footrests. The Boland '960 patent, the Dal Monte '936 patent, the Lui '923 patent, the Bengtson '002 patent, and the Turner '019 patent lack a counter. The Dal Monte '936 patent and the Butz '250 patent cannot fold in half. The Lui '923 patent does not have handles. The Butz '250 patent does not allow the user to lie flat during use. The Bengtson '002 patent and the Turner '019 patent lack adjustable handles.

Therefore, a need exists for a new and improved abdominal exerciser that can be used for allowing a user to perform situps without straining their back. In this regard, the present invention substantially fulfills this need. In this respect, the abdominal exerciser according to the present invention substantially departs from the conventional concepts and designs of the prior art, and in doing so provides an apparatus primarily developed for the purpose of allowing a user to perform situps without straining their back.

SUMMARY OF THE INVENTION

In view of the foregoing disadvantages inherent in the known types of abdominals and hip exercise machines now present in the prior art, the present invention provides an improved abdominal exerciser, and overcomes the above-mentioned disadvantages and drawbacks of the prior art. As such, the general purpose of the present invention, which will be described subsequently in greater detail, is to provide a new and improved abdominal exerciser which has all the advantages of the prior art mentioned heretofore and many novel features that result in an abdominal exerciser which is not anticipated, rendered obvious, suggested, or even implied by the prior art, either alone or in any combination thereof.

To attain this, the present invention essentially comprises a frame with a plurality of footrests and a plurality of handles attached to its end.

There has thus been outlined, rather broadly, the more important features of the invention in order that the detailed description thereof that follows may be better understood and in order that the present contribution to the art may be better appreciated.

The invention may also include a nonskid pad attached to the bottom of the frame. A cushion may be attached to the top of the frame. The frame may comprise a plurality of tubes with a cross strut connecting their middle and a cross beam connecting their end. The middle of the tubes may be hinged. The footrests may comprise a platform with a footrest mounting bracket attached to its bottom, a plurality of screws inserted through the footrest mounting bracket and threadedly attached to the bottom of the platform, a foot strap with its opposing ends attached to the opposing sides of the platform, and a plurality of pins with one end inserted through the opposing ends the foot strap and the opposing sides of the platform. The handle may comprise a handle mount with a retainer screw threadedly inserted into its top and a rod with one end inserted through its opposing sides, an adjustment hole in the middle of the rod, and a handgrip attached to the opposing end of the rod. There may be a counter attached to the handle. The frame may be made of plastic, steel, aluminum, titanium, wood, or carbon fiber composite. The cushion may be adapted for use as a seat or to fit a person's head and neck. There may be a plurality of first tubes with one end hingedly attached to the end of a plurality of second tubes. A cross strut may connect the end of the first tubes. A cross beam may connect the end of the second tubes. A plurality of footrests and a plurality of handles may be attached to the middle of the cross beam. A counter may be attached to the handgrip. The counter may be of the digital, pushbutton type. There may be a plurality of nonskid pads attached to the opposing ends of the bottom of the first tubes and the opposing ends of the bottom of the second tubes. There may be a plurality of cushions attached to the top of the first tubes and the top of the second tubes. There may be a plurality of footrest mounting brackets, a plurality of platforms, a plurality of foot straps, a plurality of handle mounts, a plurality of retainer screws, a plurality of rods, a plurality of adjustment holes, and a plurality of handgrips. A head and neck cushion may be attached to the top of the first tubes and a seat cushion may be attached to the top of the second tubes. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved abdominal exerciser that has all of the advantages of the prior art abdominal and hip exercise machines and none of the disadvantages.

It is another object of the present invention to provide a new and improved abdominal exerciser that may be easily and efficiently manufactured and marketed.

An even further object of the present invention is to provide a new and improved abdominal exerciser that has a low cost of manufacture with regard to both materials and labor, and which accordingly is then susceptible of low prices of sale to the consuming public, thereby making such abdominal exerciser economically available to the buying public.

Still another object of the present invention is to provide a new abdominal exerciser that provides in the apparatuses and methods of the prior art some of the advantages thereof, while simultaneously overcoming some of the disadvantages normally associated therewith.

Even still another object of the present invention is to provide an abdominal exerciser for allowing a user to perform situps without straining their back. This allows the user to strengthen their abdominal muscles.

Still yet another object of the present invention is to provide an abdominal exerciser for allowing a user to perform situps without straining their back. This makes it possible to store and transport the abdominal exerciser easily.

An additional object of the present invention is to provide an abdominal exerciser for allowing a user to perform situps without straining their back. This allows persons with weak abdominal muscles to comfortably perform sit-ups.

A further object of the present invention is to provide an abdominal exerciser for allowing a user to perform situps without straining their back. This allows persons with back conditions to strengthen their abdominal muscles.

A still further object of the present invention is to provide an abdominal exerciser for allowing a user to perform situps without straining their back. This allows the user to track how many repetitions have been performed.

A still yet further object of the present invention is to provide an abdominal exerciser for allowing a user to perform situps without straining their back. This allows the user to adjust the position of the hand grips.

Another object of the present invention is to provide an abdominal exerciser for allowing a user to perform situps without straining their back. This allows the user to use his or her arms and upper body to assist the upward motion of the torso if necessary.

Lastly, it is an object of the present invention to provide a new and improved abdominal exerciser for allowing a user to perform situps without straining their back.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
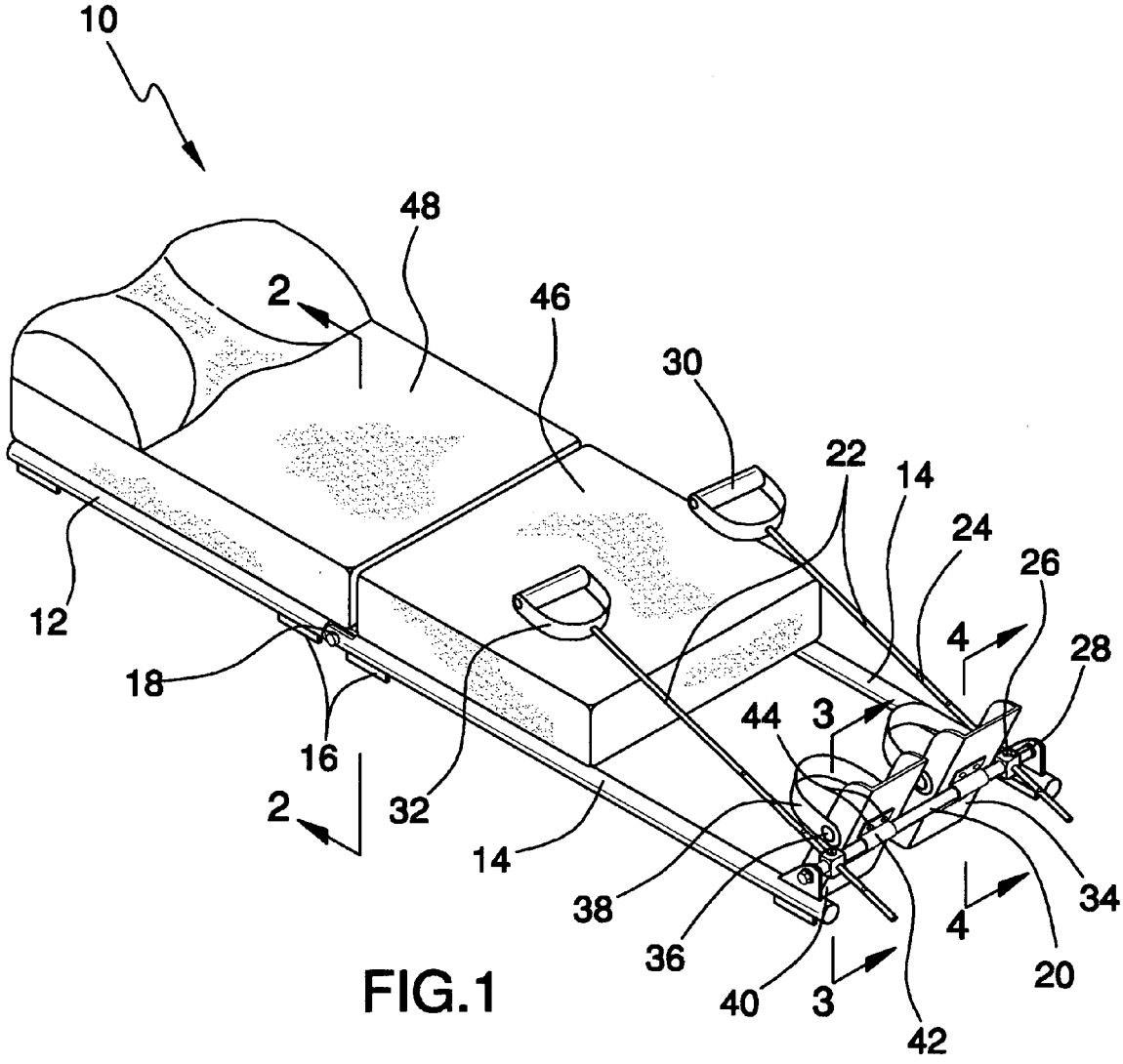
FIG. 1 is a top perspective view of the current embodiment of the abdominal exerciser constructed in accordance with the principles of the present invention.

Referring now to the drawings, and particularly to FIGS. 1–5, a current embodiment of the abdominal exerciser of the present invention is shown and generally designated by the reference numeral 10.

In FIG. 1, a new and improved abdominal exerciser 10 of the present invention for allowing a user to perform situps without straining their back is illustrated and will be described. More particularly, the abdominal exerciser 10 has a first tube 12 with one end hingedly attached to one end of a second tube 14. First tube 12 and second tube 14 are hingedly attached so that the abdominal exerciser 10 can be folded in half for ease of transport and storage. Nonskid pads 16 are attached to the bottom of first tube 12 and second tube 14 so that the abdominal exerciser 10 will not slide in use. In the current embodiment, first tube 12 and second tube 14 are made of aluminum. A head and neck cushion 48 is attached to the top of first tube 12, and a seat cushion 46 is attached to the top of second tube 14. Head and neck cushion 48 and seat cushion 46 provide support for the user (not shown). A cross strut 18 and a cross beam 20 provide structural stability to the abdominal exerciser 10. Furthermore, cross beam 20 provides mounting points for footrests 34 and handles 32. Each footrest 34 has a platform 40 attached by a footrest mounting bracket 42 and screws 44 to the cross beam 20. Each footrest 34 has a foot strap 38 with its opposing ends attached to the opposing sides of the platform 40 by pins 36. Footrests 34 hold the user's feet in place during use. Handle mounts 28 connect rods 22 to cross beam 20. A retainer screw 26 is threadedly inserted through one of the adjustment holes 24 in each rod 22 to adjust the position of handgrips 30. Handles 32 allow the user to employ their arms and upper body to assist the upward motion of the torso if necessary.

Figure 2:
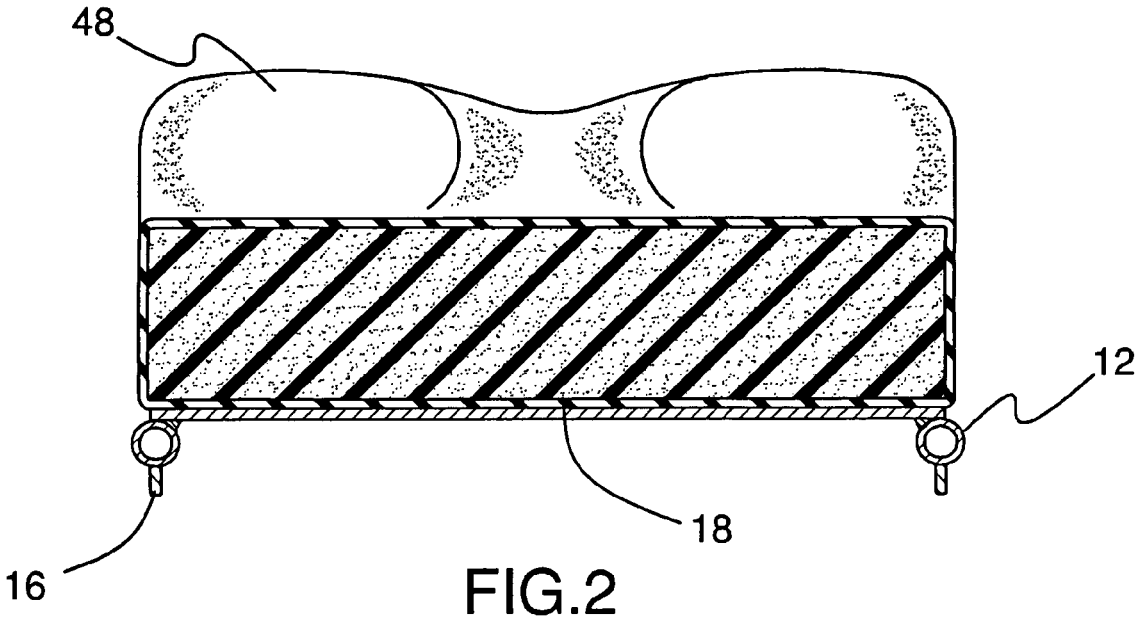
FIG. 2 is a front sectional view of the head and neck cushion of the present invention.

Moving on to FIG. 2, a new and improved head and neck cushion 48 of the present invention for allowing a user to perform situps without straining their back is illustrated and will be described. More particularly, the head and neck cushion 48 is attached to the top of first tubes 12. Nonskid pads 16 are visible attached to the bottom of first tubes 12. A cross strut 18 has its opposing ends attached to the first tubes 12 and supports the head and neck cushion 48.

Figure 3:
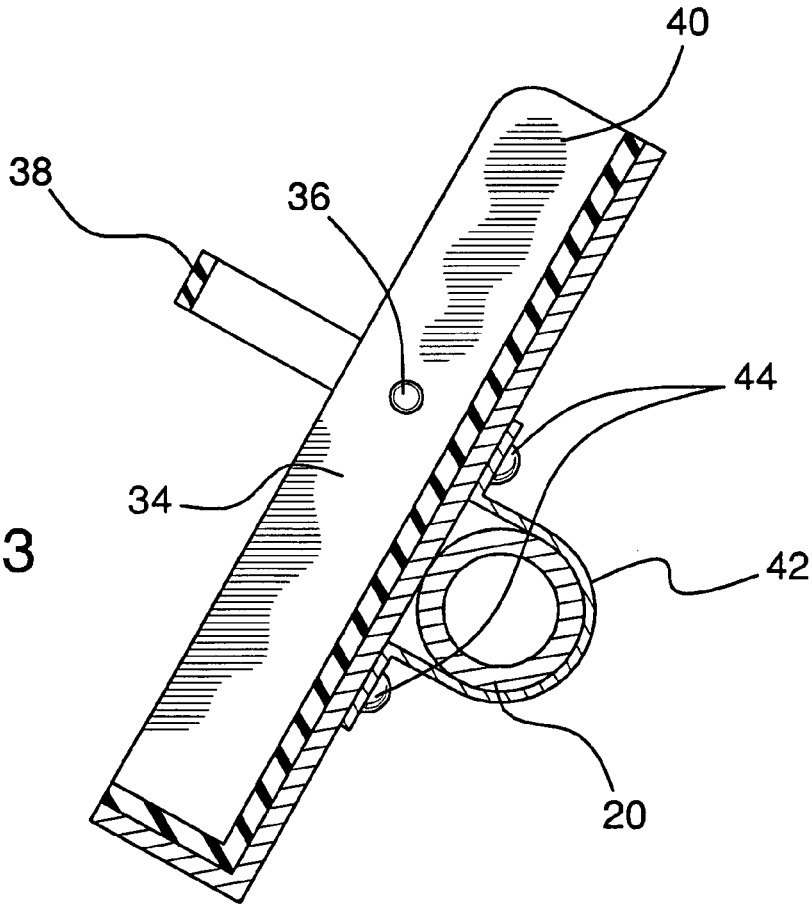
FIG. 3 is a side sectional view of the footrest of the present invention.

Continuing with FIG. 3, a new and improved footrest 34 of the present invention for allowing a user to perform situps without straining their back is illustrated and will be described. More particularly, the footrest 34 has a footrest mounting bracket 42 and screws 44 connecting the bottom of the platform 40 to the cross beam 20. A pin 36 connects one end of foot strap 38 to one side of footrest 34.

Figure 4:
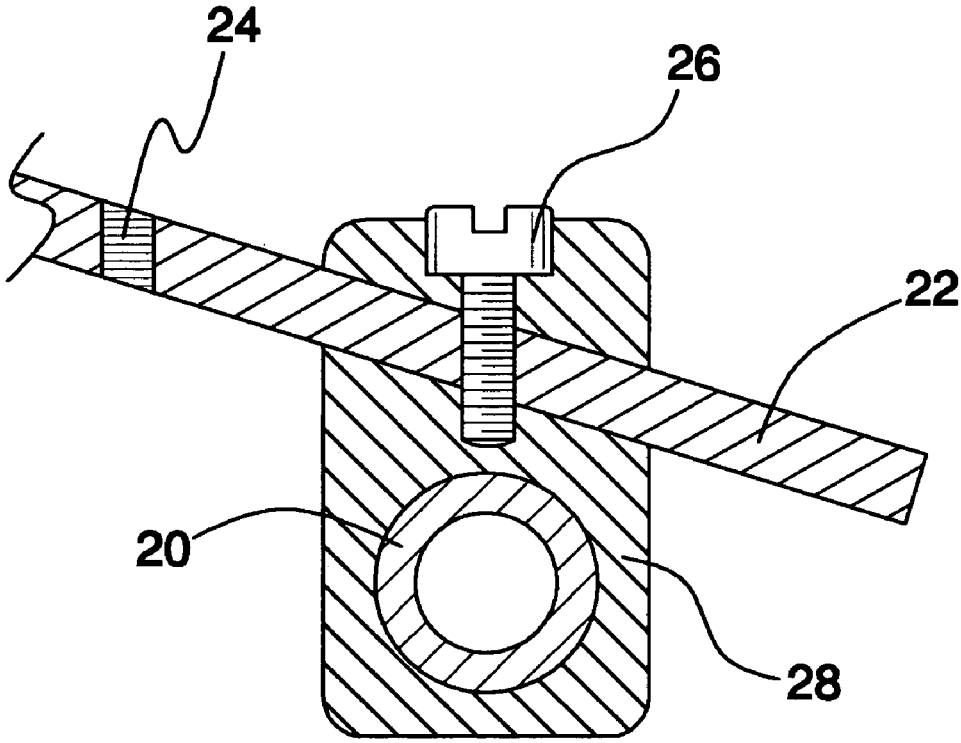
FIG. 4 is a side sectional view of the handle mount of the present invention.

In FIG. 4, a new and improved handle mount 28 of the present invention for allowing a user to perform situps without straining their back is illustrated and will be described. More particularly, the handle mount 28 encircles cross beam 20. One end of rod 22 is inserted through the middle of handle mount 28. A retainer screw 26 is threadedly inserted into the top of handle mount 28 and through one of the adjustment holes 24 in the middle of rod 22 to secure rod 22 in place within handle mount 28. The placement of handgrips 30 (not shown) can be adjusted by changing which adjustment hole 24 retainer screw 26 is inserted through.

Figure 5:
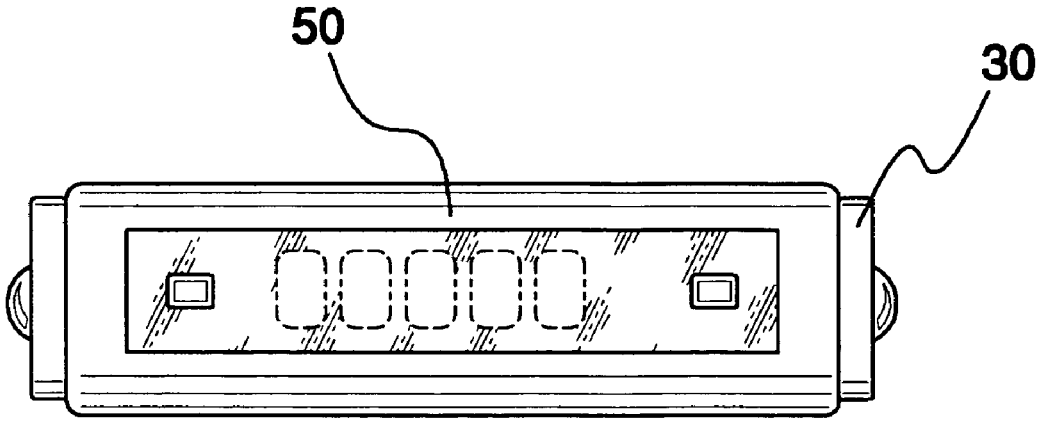
FIG. 5 is a side view of the counter of the present invention.

Concluding with FIG. 5, a new and improved counter 50 of the present invention for allowing a user to perform situps without straining their back is illustrated and will be described. More particularly, the counter 50 is attached to one side of handgrip 30. In the current embodiment, counter 50 is of the digital, pushbutton type. The counter 50 is employed by the user (not shown) to track the number of repetitions performed.

In use, it can now be understood that the user unfolds the abdominal exerciser 10 on to a flat surface. If necessary, the user adjusts the position of handgrips 30 by unscrewing retainer screws 26, sliding rods 22 within handle mounts 28 until the appropriate adjustment holes 24 are below retainer screws 26, and then tightening retainer screws 26 to hold rods 22 in place. The user then inserts his or her feet into footrests 34, grasps handgrips 30, and performs sit-up exercises. The user can use counter 50 to keep track of how many repetitions they perform. Once they are finished exercising, the user removes his or her feet from footrests 34 and folds the abdominal exerciser 10 in half for transport and/or storage.

While a current embodiment of the abdominal exerciser has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, steel, titanium, wood, or carbon fiber composite may be used instead of the aluminum first tubes and second tubes described. Also, the counter may also be a different type.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An abdominal exerciser comprising:

a plurality of first tubes having opposing ends, a top, and a bottom;

a plurality of second tubes having opposing ends, a top, and a bottom with one end hingedly attached to said end of said plurality of first tubes;

a cross strut having opposing ends with said opposing ends connected to said end of said first tubes;

a cross beam having opposing ends and a middle with said opposing ends connected to said end of said second tubes;

a plurality of footrest mounting brackets attached to said middle of said cross beam;

a plurality of platforms having a bottom and opposing sides with said bottom connected to said footrest mounting brackets;

a plurality of screws with one end inserted through said footrest mounting brackets and threadedly attached to said bottom of said platforms;

a plurality of fool straps having opposing ends with said opposing ends attached to said opposing sides of said platforms;

a plurality of pins with one end inserted through said opposing ends of said foot straps and said opposing sides of said platforms;

a plurality of handle mounts having a top, a bottom, and opposing sides with said bottom encircling said middle of said cross member;

a plurality of retainer screws threadedly inserted into said top of said handle mounts;

a plurality of rods having a head end, a foot end, and a middle with one end inserted through said opposing sides of said handle mounts;

a plurality of adjustment holes wherein said middle of said rods defines holes therein to comprise said adjustment holes; and a plurality of handgrips attached to the foot end of said rods.

2. The abdominal exerciser as defined in claim 1, further comprising:

a counter attached to one of said handgrips;

a head and neck cushion attached to said top of said first tubes;

a seat cushion attached to said top of said second tubes; and a plurality of nonskid pads attached to said opposing ends of said bottom of said first tubes and said opposing ends of said bottom of said second tubes.

* * * * *